United States Patent [19]

Hidler et al.

[11] Patent Number: 4,599,538

[45] Date of Patent: Jul. 8, 1986

[54] ELECTROLUMINESCENT DISPLAY DEVICE

[76] Inventors: Henry T. Hidler, 35 Bayberry Rd., Danvers, Mass. 01923; Lawrence L. Hope, 402 Taylor Rd., Stow, Mass. 01775; Ernest A. Davey, 11 Esquire Dr., Peabody, Mass. 01960; Martin P. Schrank, 25 Howe St., Ipswich, Mass. 01938

[21] Appl. No.: 756,560

[22] Filed: Jul. 18, 1985

Related U.S. Application Data

[63] Continuation of Ser. No. 431,954, Sep. 30, 1982, abandoned.

[51] Int. Cl.[4] ..... H05B 33/04; H05B 33/10

[52] U.S. Cl. ..... 313/512; 427/66; 445/44

[58] Field of Search ..... 313/512, 510, 505, 583, 313/509; 174/50.52, 50.6, 50.64, 52 FF; 427/66; 445/44

[56] References Cited

U.S. PATENT DOCUMENTS

| | | | |
|---|---|---|---|
| 2,606,215 | 8/1952 | Lamb | 174/50.6 X |
| 3,330,982 | 8/1964 | Dickson, Jr. | 313/512 X |
| 4,137,481 | 1/1979 | Hilsum et al. | 313/512 X |
| 4,140,937 | 2/1979 | Vecht et al. | 313/509 X |
| 4,289,922 | 9/1981 | Devlin | 174/52 FP |
| 4,355,463 | 10/1982 | Burns | 174/52 FP X |
| 4,446,399 | 5/1984 | Endo et al. | 313/512 X |

*Primary Examiner*—Palmer C. DeMeo

*Attorney, Agent, or Firm*—Jose W. Jimenez; William H. McNeil

[57] ABSTRACT

An improved hermetic seal means for use in an electroluminescent display device for joining the protective cover sheet (glass) over the base substrate. The base substrate has typically deposited thereon multiple thin film layers. The hermetic seal comprises an electrically insulative thin film layer disposed over the conductive thin film leads associated with the multiple thin film layers, and metallic solder means over the insulative thin film layer to provide a bond between the cover sheet and base substrate.

12 Claims, 3 Drawing Figures

ELECTROLUMINESCENT DISPLAY DEVICE

This application is a continuation of application Ser. No. 431,954, filed Sept. 30, 1982 and now abandoned.

TECHNICAL FIELD

The present invention relates in general to thin film, multi-layer, electroluminescent display devices, and more particularly, to an improved hermetic seal for use with such electroluminescent display devices.

BACKGROUND ART

In the construction of thin film electroluminescent display devices, there is a requirement for a hermetic seal to protect the device against contamination. Water vapor is in particular damaging to the thin films that are deposited in constructing the display device. Any water or humidity penetration of the hermetic seal causes rapid degradation in display performance. Even relatively slow water penetration substantially shortens the useful life of the display. This hermetic seal is typically provided between the glass substrate upon which the thin films are deposited, and a cover sheet usually in the form of a protective glass plate.

At the present time, there are two types of hermetic seals that are predominantly used; one an epoxy seal and the other a glass frit seal. The epoxy hermetic seal particularly has problems under excess humidity conditions. Present epoxy seals are effective under high humidity conditions for only up to periods of seven hundred hours of operation. The glass frit seal does not suffer from degradation under high humidity conditions, but it does break down at higher temperatures.

DISCLOSURE OF INVENTION

It is, therefore, an object of this invention to obviate the disadvantages of the prior art.

It is an other object of the present invention to provide an improved hermetic seal for a thin film electroluminescent display device. This hermetic seal is between the display substrate and a cover sheet (protective glass plate).

Another object of the present invention is to provide an improved electroluminescent display device having a hermetic seal that provides substantially total protection against penetration of water vapor and other contaminants.

Still another object of the present invention is to provide an improved hermetic seal for an electroluminescent display device having increased operating life and having substantially total resistance to damage from humidity. This permits use of the electroluminescent display device in outdoor and other harsh environments.

A further object of the present invention is to provide an improved technique for hermetically sealing thin film electroluminescent display devices in which the technique is carried out easily and effectively and is compatible with associated steps carried out in the fabrication of the display device.

These objects are accomplished, in one aspect of the invention, by the provision of an electroluminescent display having a base substrate upon which multiple thin film layers are formed including electrically conductive thin film leads. A protection cover sheet is disposed over the layers. Hermetic seal means join the cover to the base substrate and includes an electrically insulating thin film layer disposed over the conductive thin film leads, and metallic solder means over the insulative thin film layer.

In accordance with the fabrication process of the present invention, the hermetic seal is formed by first applying the electrically insulative thin film layer over the conductive thin film leads of the substrate and/or cover sheet. After the leads are covered by the insulating film in the area to be sealed, the metallic solder sealing material is applied to the seal area preferably on both the base substrate and cover sheet.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

There is now described in detail a sealing technique and associated method of fabrication for providing a true hermetic seal between the base substrate and cover sheet or cover plate of an electroluminescent display device. The sealing is provided by means of a eutectic (solder) metal, or combinations of metal preferably disposed in a picture frame configuration about the periphery of the display substrate. The cover sheet, which may be glass, ceramic or other material, is typically a flat element lying in a plane lying in parallel to the substrate and separated from the substrate by the aforementioned picture frame seal. The cover sheet may carry leads, drive chips, or other ancillary components. In combination with the metal seal is a thin film dielectric insulating layer which covers the area on the substrate and cover sheet over which the electrical leads pass and upon which the metallic seal is formed. This insulating layer extends beyond the seal area to provide a safety margin.

Figure 1:
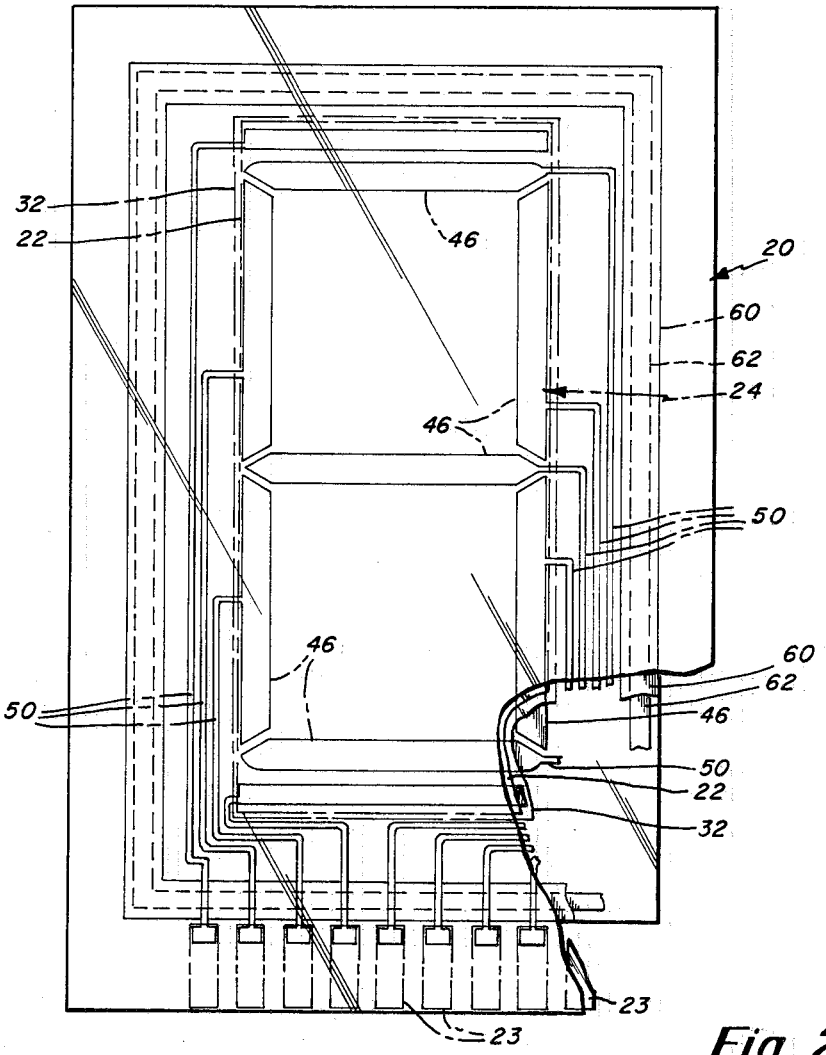
FIG. 1 is a plan view of an electroluminescent display constructed in accordance with the present invention and employing the hermetic seal thereof.
Figure 2:
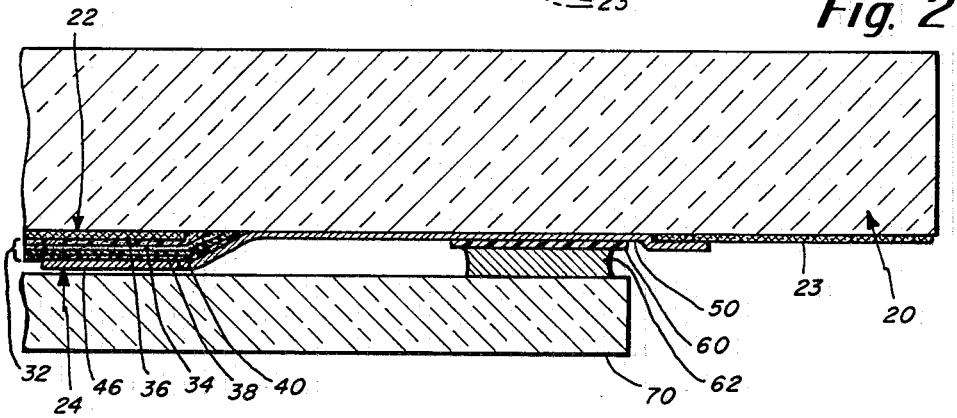
FIG. 2 is a cross-sectional view showing the construction of the display including the forming of the hermetic seal.
Figure 3:
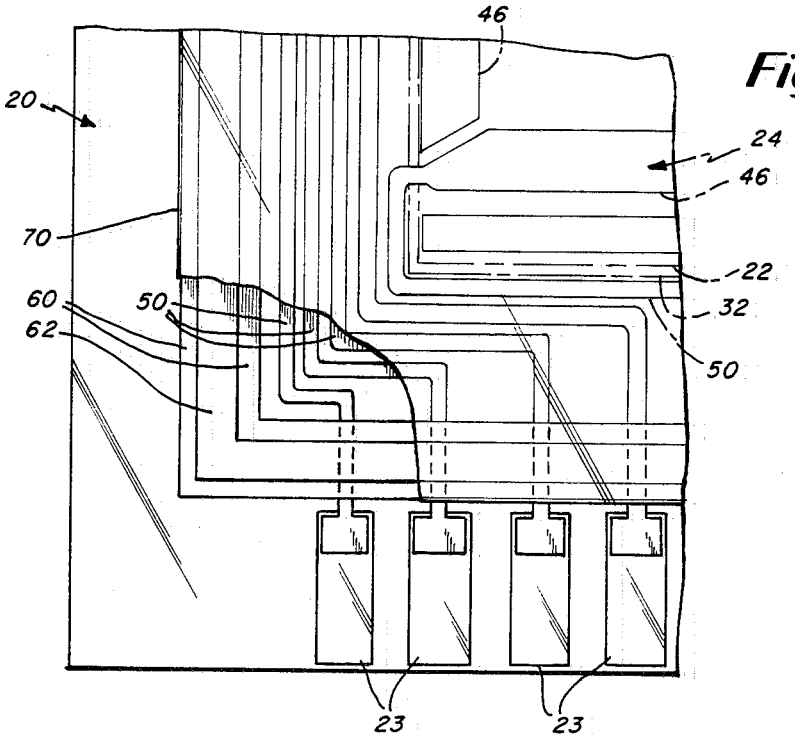
FIG. 3 is a fragmentary rear view showing further details of the hermetic seal.

With reference to the drawings, FIG. 1 is a plan view of an electroluminescent display constructed in accordance with the present invention and employing the hermetic seal of the invention. FIG. 2 is a cross-sectional view showing the details of the hermetic seal and other thin films associated with the display device. Finally, FIG. 3 is a fragmentary rear view showing further details of the hermetic seal.

In the illustrated embodiment the different layers that are shown may be deposited by known techniques such as by vapor deposition, thermal evaporation, electron beam evaporation or sputtering. Because the deposition process is basically known, it is not discussed in any detail herein. Also, because the formation of the basic thin films such as those forming the phosphor is also well known, the process involving the deposition of these thin films is not described in detail herein.

The thin film, multi-layer electroluminescent device basically comprises, from front to back, a glass substrate 20, a transparent front electrode or conductor pattern 22, and an aluminum back electrode pattern 24. The front electrode pattern 22 and the back electrode pattern 24 are formed by known deposition techniques with the employment of the proper mask. FIG. 1 shows the deposited patterns for the transparent front electrode pattern 22 and the aluminum back electrode pattern 24.

The back electrode pattern 24 may be formed by the deposition of a metal such as aluminum. The transparent front electrode pattern pattern may be formed by the deposition of a doped tin oxide. Alternatively, the front electrode pattern may also be constructed by depositing an indium-tin oxide.

There is provided between the front and back electrodes, a layer 32 that includes at the very least, the phosphor. FIG. 2 shows the layer 32 as actually being formed, in one embodiment, by four separate layers, including the phosphor layer 34, the dark field layer 40, and dielectric layers 36 and 38. The layer 36 is a dielectric layer that functions as a capacitive ballast layer. This may be formed of a material such as yttrium oxide. The phosphor layer 34 may be formed of a zinc sulfide usually doped with manganese. Another material that may be used as a phosphor is zinc selenite. The layer 38 is usually formed of silcion nitride. Layer 38 is a dielectric insulating layer. The dark field layer 40 may consist of a cermet of chromium oxide and chromium.

In the display device there is also provided a plurality of aluminum lead-ins 50 for providing electrical connection to the segments 46 of the back electrode pattern 24. FIG. 1 shows the aluminum lead-ins 50 extending to the transparent electrode terminal pads 23.

With reference to FIG. 1, it is noted there are provided seven such aluminum lead-ins 50 associated respectively with the seven segments 46 of the single digit display. In addition, there are also two additional aluminum lead-ins that couple from the front electrode pattern 22. All of these aluminum lead-ins are shown in FIG. 1, coming out at the pads 23.

FIG. 2 shows the additional layers that form the hermetic seal of the present invention. These layers include a first layer which is an insulating layer preferably of silicon nitride in combination with a eutectic sealing material. These are illustrated in FIG. 2 as respective layers 60 and 62. The basic sealing function is provided by the eutectic mixture or metallic sealing element. The silicon nitride layer 60 functions primarily as an insulating layer so as to insulate the metallic sealing layer 62 from any electrical leads that pass beneath it. In this regard note FIG. 3 and leads 50 that pass under the sealing area. Although, FIG. 2 illustrates such aluminum leads as coupling only from the back electrode 24, it is understood that such leads may also be in the form of conductive thin films associated with the cover sheet or a back glass 70. Also note, as illustrated in FIG. 1, that the sealing area is in a picture frame configuration so as to provide a total hermetic seal about the entire display area.

The silicon nitride layer 60 may be deposited using substantially the same equipment as is used for depositing the other thin film layers forming the electroluminescent device. Alternatively, the silicon nitride layer 60 may be deposited using separate equipment. This insulating layer covers the area on the substrate or the cover sheet over which the electrical leads pass and upon which the metallic seal lies. The insulating layer, as illustrated in FIG. 3, extends beyond the seal layer to provide a safety margin.

After the conductive thin film leads associated with the base substrate and/or cover sheet are covered by the insulating film in the seal area, the eutectic metallic solder layer 62 is applied to the seal area on both the substrate and cover sheet in substantially identically shaped picture frame configurations, such as illustrated in FIG. 1. The application of the layer 62 may be by known techniques such as by flashing or other means of deposition. These separately deposited picture frame configurations of the layer 62 are then mated and heated so that the solder material meets and flows together to form a single seal between the base substrate and cover sheet or protective back glass.

In an alternative technique for forming the hermetic seal, the eutectic sealing material may be applied in a paste form such as by depositing a bead in a picture frame configuration. In this instance, the device is then subjected to heat for driving off binders or other foreign materials associated with the paste. Also, the eutectic sealing material is one that is chosen for good adherence to the insulating film.

In practicing the method of forming the hermetic seal of this invention, it is preferred that the fabrication of the electroluminescent device be carried out in a dry box or other controlled environment. When using a dry box the parts are inserted, mated, and heated to reflow the seal material. If required, an additional layer of the metallic seal material may be used between the sealing elements on the substrate and cover sheet.

In a preferred embodiment described herein, the layer 62 may be formed of a tin solder and the insulating layer is preferably silicon nitride.

While there have been shown and described what are at present considered to be the preferred embodiments of the invention, it will be apparent to those skilled in the art that various changes and modifications can be made herein without departing from the scope of the invention as defined by the appended claims.

We claim:

1. In an electroluminescent display device having a base substrate upon which multiple thin film layers are formed including electrically conductive thin film leads and a protective cover sheet disposed over the thin film layers, the improvement comprising hermetic seal means for joining the cover sheet over the base substrate including an electrically insulative thin film layer disposed over the conductive thin film leads and metallic solder means over the insulative thin film layer, the area of said substrate covered by said insulative thin film layer being greater than said metallic solder means, and said hermetic seal means not including a protective medium disposed between the base substrate and the cover sheet while providing a bond between the cover sheet and base substrate without causing shorting between leads.

2. In an electroluminescent display as set forth in claim 1 wherein said insulative thin film layer and metallic solder means are disposed in a picture frame configuration.

3. In an electroluminescent display as set forth in claim 1 wherein said cover sheet comprises a glass plate.

4. In an electroluminescent display as set forth in claim 1 wherein said cover sheet comprises a ceramic plate.

5. In an electroluminescent display as set forth in claim 1 wherein said metallic solder means comprises tin.

6. In an electroluminescent display as set forth in claim 1 wherein the electrically insulative thin film layer is comprised of silicon nitride.

7. In an electroluminescent display as set forth in claim 1 wherein the electrically insulative thin film layer is comprised of silicon oxide.

8. In an electroluminescent display as set forth in claim 1 wherein the electrically insulative thin film layer is comprised of silicon dioxide.

9. In an electroluminescent display as set forth in claim 1 wherein the solder means is a eutectic mixture.

10. In an electroluminescent display device having a base substrate upon which multiple thin film layers are formed including electrically conductive thin film leads and a protective cover sheet disposed over the thin film layers, the improvement comprising a method of forming a hermetic seal between the base substrate and the cover sheet including depositing an electrically insulative layer over the conductive thin film leads, and depositing a metallic solder over the insulative layer and on both the base substrate and cover sheet, said step of depositing said insulative layer including depositing said insulative layer to cover an area of said substrate greater than said metallic solder, and said method not including the step of providing a protective medium disposed between the substrate and cover sheet.

11. In an electroluminescent display as set forth in claim 10 including mating the substrate and cover sheet with the deposited solder areas respectively thereof aligned and applying heat to join the base substrate and cover sheet and form a hermetic seal therebetween.

12. In an electroluminescent display as set forth in claim 11 wherein the solder area is deposited as a paste.

* * * * *

UNITED STATES PATENT AND TRADEMARK OFFICE

CERTIFICATE OF CORRECTION

PATENT NO. : 4,599,538

DATED : July 8,1986

INVENTOR(S) : HENRY T. HIDLER ET AL.

It is certified that error appears in the above-identified patent and that said Letters Patent are hereby corrected as shown below:

On the title page, insert:

--[73] Assignee: GTE Products Corporation
Danvers, MA--

Signed and Sealed this

Fourteenth Day of October, 1986

[SEAL]

*Attest:*

DONALD J. QUIGG

*Attesting Officer*

*Commissioner of Patents and Trademarks*